US006378780B1

(12) United States Patent
Martens, III et al.

(10) Patent No.: US 6,378,780 B1
(45) Date of Patent: Apr. 30, 2002

(54) DELIVERY SYSTEM FOR DISPENSING VOLATILES

(75) Inventors: Edward J. Martens, III; David A. Tomkins, both of Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/499,601

(22) Filed: Feb. 7, 2000

Related U.S. Application Data

(60) Provisional application No. 60/119,298, filed on Feb. 9, 1999.

(51) Int. Cl.[7] ..... B05B 1/08
(52) U.S. Cl. ..... 239/102.2
(58) Field of Search ..... 239/102.1, 102.2, 239/4, 145

(56) References Cited

U.S. PATENT DOCUMENTS

| | | | |
|---|---|---|---|
| 3,543,122 A | 11/1970 | Klebanoff et al. | |
| 3,615,041 A | 10/1971 | Bischoff | |
| 4,268,460 A | 5/1981 | Boiarski et al. | |
| 4,479,609 A | 10/1984 | Maeda et al. | |
| 4,533,082 A | 8/1985 | Machara et al. | |
| 4,628,040 A | 12/1986 | Green et al. | |
| 4,656,963 A | 4/1987 | Yonehara et al. | |
| 4,702,418 A | 10/1987 | Carter | |
| 4,790,479 A | 12/1988 | Matsumoto et al. | |
| 5,297,734 A | 3/1994 | Toda | |
| 5,312,281 A | 5/1994 | Takahashi et al. | |
| 5,382,410 A | 1/1995 | Peltier | |
| 5,518,179 A | 5/1996 | Humberstone et al. | |
| 5,657,926 A | 8/1997 | Toda | |
| 5,736,195 A | 4/1998 | Haaland | |
| 5,823,428 A | 10/1998 | Humberstone et al. | |
| 5,938,117 A | 8/1999 | Ivri | 239/4 |

FOREIGN PATENT DOCUMENTS

| | | |
|---|---|---|
| EP | 0678337 A1 | 3/1995 |
| EP | 0762211 A1 | 8/1996 |
| GB | 973458 | 10/1962 |
| GB | 2 073 616 | 4/1981 |
| RU | 1007752 | 3/1983 |

*Primary Examiner*—Lisa Ann Douglas

(57) ABSTRACT

Disclosed herein is a piezoelectric liquid delivery system or atomizer for production of droplets of liquid or liquid suspensions by a battery operated dispenser utilizing an orifice plate in communication with a piezoelectric element. By control of the viscosity and surface tension of the liquid to be dispersed, an improved method of dispensing such liquid is achieved.

7 Claims, 4 Drawing Sheets

DELIVERY SYSTEM FOR DISPENSING VOLATILES

PRIORITY

This application claims the benefit of U.S. Provisional Application No. 60/119,298, filed Feb. 9, 1999.

TECHNICAL FIELD

The present invention relates to means for the distribution of a liquid active material, such as a perfume, air freshener, insecticide formulation, or other material, in the form of fine particles or droplets, as in a fine spray, by means of a piezoelectric device. In particular, the invention is directed to a piezoelectric liquid delivery system for production of droplets of liquid, or liquid suspensions, by means of an electromechanical or electroacoustical actuator. More specifically, the present invention relates to a battery operated dispenser utilizing an orifice plate in communication with a piezoelectric element. By control of the viscosity and surface tension of the liquid to be dispersed, an improved method of dispensing such liquids is achieved.

BACKGROUND ART

The distribution of liquids by formation of a fine spray, or atomization, is well known. One method for such distribution is to atomize a liquid by means of the acoustic vibration generated by an ultrasonic piezoelectric vibrator. An example of such a method is shown in Carter, U.S. Pat. No. 4,702,418, which discloses an aerosol dispenser including a nozzle chamber for holding fluid to be dispensed and a diaphragm forming at least a portion of the chamber. An aerosol dispensing nozzle is disposed therein, with a restrictive passage for introducing liquid from the reservoir to the nozzle. A pulse generator in combination with a low voltage power source is used to drive a piezoelectric bender, which drives fluid from the reservoir through the nozzle to create an aerosol spray.

Another atomizer spraying device is shown by Humberstone et al, in U.S. Pat. No. 5,518,179, which teaches a liquid droplet production apparatus comprising a membrane which is vibrated by an actuator which has a composite thin-walled structure, and is arranged to operate in a bending mode. Liquid is supplied directly to a surface of the membrane and sprayed therefrom in fine droplets upon vibration of the membrane.

U.S. Pat. Nos. 5,297,734 and 5,657,926, of Toda, teach ultrasonic atomizing devices comprising piezoelectric vibrators with a vibrating plate connected thereto. In U.S. Pat. No. 5,297,734, the vibrating plate is described as having a large number of minute holes therein for passage of the liquid.

While a number of additional patents disclose means for the dispersion of liquids by ultrasonic atomization, or for timed intervals of dispersion, they have achieved only moderate success in the efficient atomization of such materials as perfumes. See, for example, U.S. Pat. Nos. 3,543,122, 3,615,041, 4,479,609, 4,533,082, and 4,790,479. The disclosures of these patents, and of all other publications referred to herein, are incorporated by reference as if fully set forth herein.

Such atomizers fail to provide an easily portable, battery operated dispenser employing an orifice plate in mechanical connection with a piezoelectric element, capable of long periods of use with little or no variation in the delivery rate. Thus, a need exists for improved atomizers or dispensers for use in distribution of active fluids such as fragrances and insecticides, which atomizers are highly efficient and consume minimal electrical power while providing wide dispersal of the liquid.

DISCLOSURE OF INVENTION

A primary purpose of the present invention is to provide a highly efficient method for dispensing such liquids as perfumes, air fresheners, or other liquids. Such other liquids include household cleaning materials, sanitizers, disinfectants, repellants, insecticides, aroma therapy formulations, medicinals, therapeutic liquids, or other liquids or liquid suspensions which benefit from atomization for use. These compositions may be aqueous, or comprise various solvents.

It is an object of the present invention to provide an easily portable, battery operated dispenser employing a domed orifice plate in mechanical connection with a piezoelectric element. It is a further object to provide a piezoelectric pump capable of operating efficiently for months, on low voltage batteries, while maintaining consistency of delivery throughout the period. Included in such object is to provide a piezoelectric atomizer capable for use with such electrical sources as 9 volt batteries, conventional dry cells such as "A", "AA", "AAA", "C", and "D" cells, button cells, watch batteries, and solar cells. The preferred energy sources for utilization in combination with the present invention are "AA" and "AAA" cells.

In still another object, it is desired to provide a liquid delivery system capable of atomizing such liquids as fragrance oil or insecticide formulations linearly over time, while maintaining the same character/composition on the last day as was delivered on the first, i.e. with no component change or separation with time. The electronics of such a unit may be programmable, and may be used to set a precise delivery rate (in milligrams per hour, hereinafter mg/hr). Alternatively, the electronic circuitry may allow the consumer to adjust intensity or effectiveness to a desired level for personal preference, efficacy, or for room size.

Another object of this invention is to provide small particles of pure fragrance or insecticide formulation which may be propelled intermittently from the unit to form a small "cloud" or "puff," which particles quickly diffuse and move throughout a large area on air currents present in said area. It is found that the small size of such particles, and the correspondingly large ratio of surface area to mass, result in these liquid particles evaporating quickly and uniformly. In preferred embodiments, the delivery system operates with a linear delivery rate for several months on a single 1.5 volt "AA" size battery, delivering uniform volumes of essentially equally sized droplets of the liquid for the entire period.

In the preferred embodiment of the present invention, these and other objects of this invention are achieved by an atomizer for fragrances, insecticide formulations, and other liquids such as set forth previously, wherein the atomization system includes a chamber for the liquid to be dispensed, means to supply the liquid from said chamber to an orifice plate for dispersal of the liquid, a piezoelectric element, an energy source, and circuitry to drive and control the piezoelectric element. The fragrance, insecticide formulation, or other desired liquid is supplied to the back side of the orifice plate through a liquid transport means such as a capillary feed system that delivers the liquid in surface tension contact with the plate The piezoelectric element may be driven by circuitry powered by a small battery, causing the element to vibrate and forcing liquid through the orifice plate, which has one or more small tapered or conical holes therein, perpendicular to the surfaces thereof, the exit of said holes being on the order of from about 1 to about 25 microns, preferably from about 4 to about 10 microns, and most preferably from about 5 to about 7 microns in diameter. It has been found that by limiting the use of liquids to those which exhibit viscosity below 10 centipoise, and which have surface tensions below about 35, and preferably in the range of from about 20 to about 30 dynes per centimeter, superior results are attained. The present invention thus provides a means for uniform atomization of the liquid to be dispensed throughout the total period of dispersion, such that the amount dispersed per time unit at the commencement of dispersion does not vary from the amount dispersed near or at the finish of dispersion. Viscosity is in centipoise, as determined using the Bohlin CVO Rheometer system in conjunction with a high sensitivity double gap geometry. Surface Tension results, in dynes per centimeter, were generated using the Kruss K-12 tensionmeter operating under the Wilhelmy Plate protocol. These and still other objects and advantages of the present invention will be apparent from the description which follows, which is, however, merely of the preferred embodiments. Thus, the claims should be looked to in order to understand the full scope of the invention.

MODES FOR CARRYING OUT THE INVENTION

It is to be understood that the Figures, and the discussion below, are directed to preferred embodiments of the invention, but that the invention itself is broader than the illustrations given. Specifically, the invention is equally applicable to other forms of piezoelectric atomization, such as the use of cantilever beams and/or amplifying plates, as well as atomizers driven by conventional electric power, i.e. wall plug, rather than battery powered.

Figure 1:
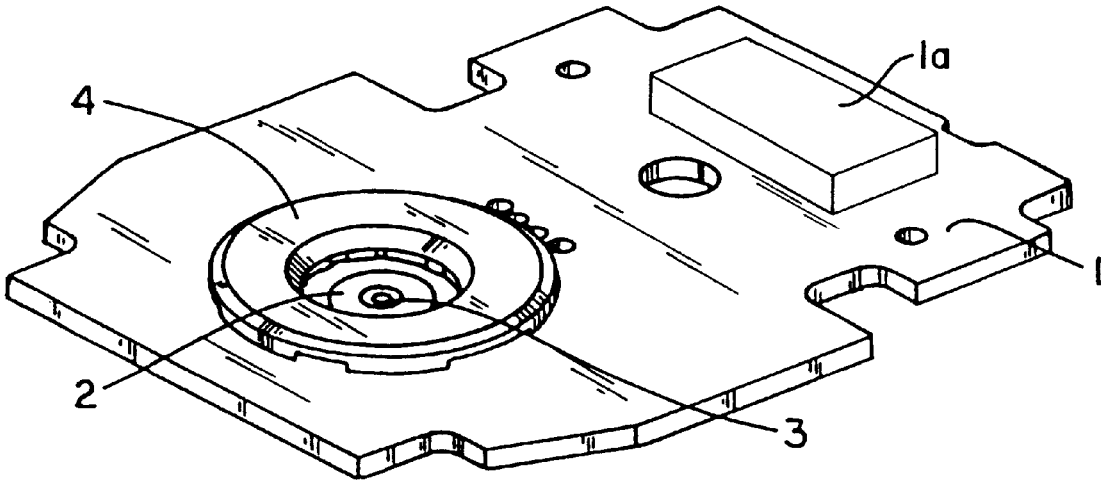
FIG. 1 is a partial isometric view of a circuit board suitable for use in a piezoelectric atomizer in accordance with a preferred embodiment of the present invention.

FIG. 1 illustrates the general relationship between the printed circuit board, 1, and the piezoelectric element 2 located therein. The circuit board, 1, has mounted thereon electronic circuitry 1*a* and a battery (not shown) is associated therewith. The electronic circuitry is programmable, and may be used to set a precise delivery rate (in milligrams per hour) and to provide intermittent release of small particles from the plate. It is also to be understood that the circuit board may be, in use, attached to the chassis of the dispenser, which chassis may in turn be placed in a decorative shell-like housing or receptacle (not shown) for use. The chassis board 11 is shown in top view in FIG. 5, while the housing is not illustrated. The decorative receptacle or housing may be of any form or shape suitable for the purpose of retaining and protecting the elements of the dispenser while providing a pleasing appearance to the consumer, and permitting passage of the liquid, in spray form, from the dispenser to the atmosphere. As such, the dispenser housing may be advantageously produced by high speed molding of any material suitable for use with, and contact with, the liquid to be dispensed.

Piezoelectric element 2 may be mounted as illustrated in the circuit board 1, held in place by grommet 4, or by any similar suitable means which does not inhibit vibration of the element. The piezoelectric element 2, in the form of a ring, is positioned in an annular relationship to the orifice plate 3, and is attached to the orifice plate flange so as to be in vibratory communication therewith. The piezoelectric element generally comprises a piezoelectric ceramic material, such as a lead zirconate titanate (PZT) or lead metaniobate (PN), but may be any material exhibiting piezoelectric properties.

The orifice plate comprises any conventional material suitable for the purpose, but is preferably comprised of an electroplated nickel cobalt composition formed upon a photoresist substrate which is subsequently removed in conventional manner to leave a uniform porous structure of nickel cobalt having a thickness of from about 10 to about 100 microns, preferably from about 20 to about 80 microns, and most preferably about 50 microns. Other suitable materials for the orifice plate may be utilized, such as nickel, magnesium-zirconium alloy, various other metals, metal alloys, composites, or plastics, as well as combinations thereof. By forming the nickel cobalt layer through electroplating, a porous structure having the contour of the photoresist substrate may be produced, in which permeability is achieved by formation of conical holes having a diameter of about 6 microns on the exit side, and a larger diameter on the entrance side. The orifice plate is preferably dome shaped, i.e. somewhat elevated at the center, but may vary from flat to parabolic, arc shaped, or hemi-spherical in shape, or any other suitable shape which enhances performance. The plate should have a relatively high bending stiffness, to assure that the apertures therein shall be subject to essentially the same amplitude of vibration, so as to simultaneously eject droplets of liquid which are uniform in diameter.

While shown in the form of an annular ceramic piezoelectric element surrounding an orifice plate or aperture, it is also conceived that the present invention is also suitable for use with a conventional piezoelectric element comprising an oscillator and a cantilever beam in contact with a diaphragm, nozzle, or orifice plate suitable for dispersion of liquid droplets or fog.

Figure 2:
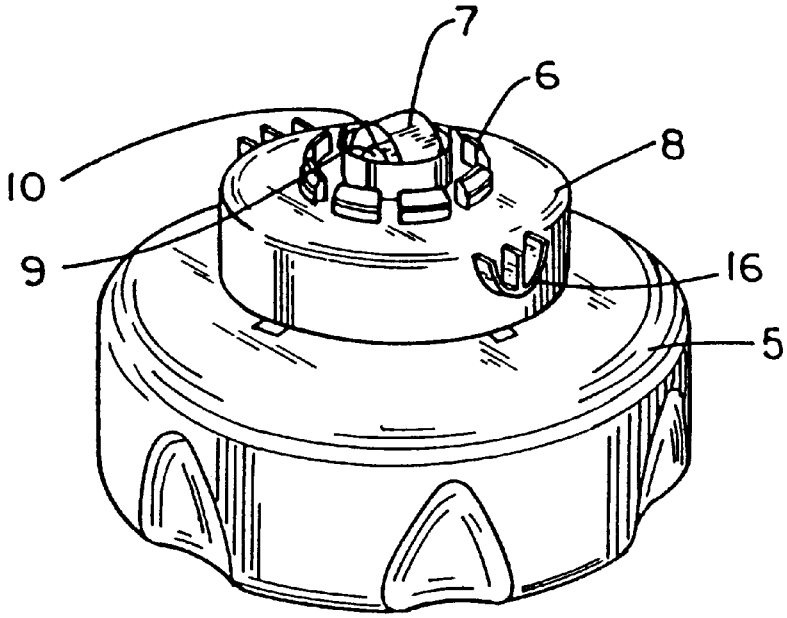
FIG. 2 is an isometric view of a liquid container and liquid transport means suitable to bring the liquid to the surface of the orifice plate.

Also shown in FIG. 2 is the liquid container 5 for storage and provision of the fragrance, air freshener, insect control liquid, or other material to be dispensed. As illustrated, the container is closed by a closure 8. Also shown are bayonet clips 6, which are present to hold a removable top closure, or cap, not shown, which is used in transport and storage of the container, and may be removed easily when it is desired to put the container into the dispenser and permit use of the contents thereof. From bottle opening 9, exiting through the closure 8, projects the liquid supply means 7, a wick or dome shaped liquid feed medium. For convenience, we shall refer to the liquid supply means as a wick, although it may comprise a number of varying shapes and materials, from hard capillary systems to soft porous wicks. The function of the wick is to transport liquid from container 5 to a position in contact with the orifice plate. Thus, the liquid supply means 7 serves as a liquid conduit for supplying the liquid from the container to the orifice plate. Accordingly, the wick should be unaffected by the liquid being transported, porous, and permit compliance with the orifice plate. The porosity of the wick should be sufficient to provide a uniform flow of liquid throughout the range of flexibility of the wick, and in any configuration thereof. To best transport the liquid to the surface of the orifice plate, it has been found necessary that the wick itself physically contact the plate to transfer the liquid to the orifice plate. Liquid is preferably delivered to the orifice plate in such a manner that essentially all delivered liquid will adhere to and transfer to the plate surface by surface tension. Among suitable wick materials, we have found it preferable to utilize such materials as paper, or fabrics of nylon, cotton, polypropylene, fiber glass, etc. The wick may preferably be shaped to conform to the surface of the orifice plate to which it is juxtaposed, and held in the correct position by a wick holder or positioner, 10, located in the bottle opening 9, of the closure 8 of liquid container 5. Liquid will flow readily from the wick to the plate as a result of the viscosity and surface tension of the liquid. It is to be noted that the wick is intended to be included as an integral part of a liquid resupply unit, which will comprise the container, the liquid, the bottle closure, the wick, and the wick holder or positioner, as well as a top closure to seal the unit for storage and shipment. Such a unit may thus comprise a refill bottle for the dispenser, suitable to be placed in the dispenser at the consumers convenience. To this end, as shown in FIG. 2, the liquid container 5 may have attachment means 16 on the bottle closure 8, for insertion into a suitable receiving means in the chassis 11 to lock it in operative position, after removal of the top closure or cap.

Figure 3:
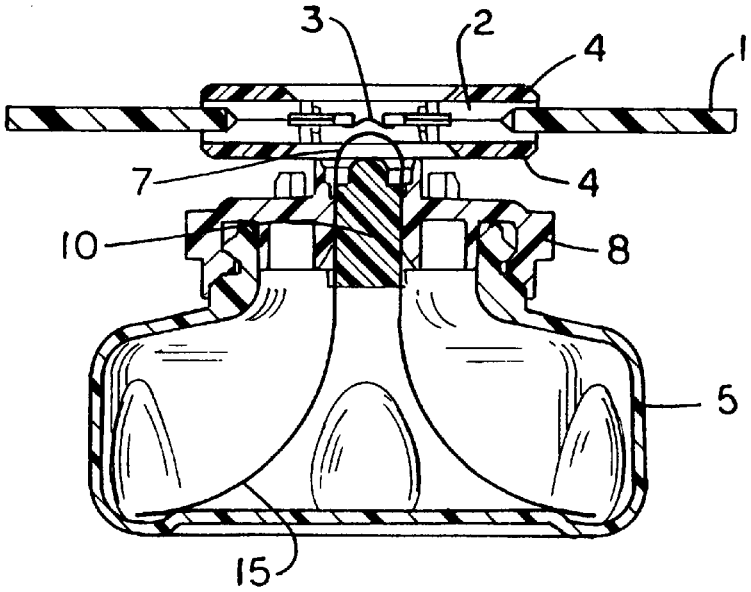
FIG. 3 is a cross sectional view showing the relationship of the liquid container, the feed means, and the piezoelectric element.
Figure 4:
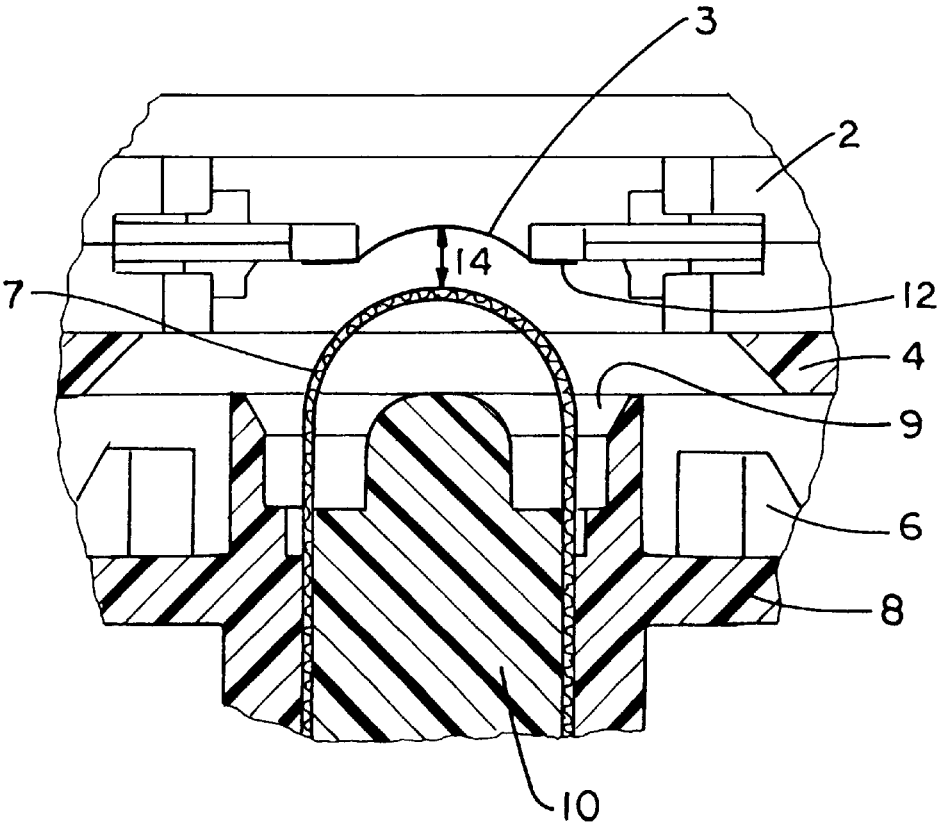
FIG. 4 is a magnified detail of the area of FIG. 3 enclosed within the circle.

FIG. 3 illustrates, in cross sectional view, the relationship between the liquid container 5, the wick 7, the piezoelectric element 2, and the orifice plate 3 of a specific preferred embodiment of the invention. The piezoelectric element 2 is positioned, for example, in printed circuit board 1, by grommets 4, or by any suitable means which does not restrict vibration of the piezoelectric element. In a preferred embodiment of the invention, the annular piezoelectric element sur-rounds the orifice plate 3, in mechanical connection therewith. The orifice plate is, in turn, in contact with the wick 7, permitting the liquid to be dispensed from the container 5 to the orifice plate, where transfer occurs through surface tension contact. Not shown is the chassis board 11 of the dispenser, which holds the circuit board I and the liquid container in the appropriate position to bring wick 7 into juxtaposition with the orifice plate 3. Wick 7 is held in the opening of closure 8 by the wick holder 10, which permits a degree of freedom to the flexible wick 7, so as to allow a range of adjustment thereof, while wick tail 15 assures complete utilization of all the liquid in the container 5. This degree of freedom permits self-adjustment of the wick relative to the surface of the orifice plate, to compensate for variations in position resulting from the vagaries of manufacture, and provides for a compliant feed means for transfer of the liquid from the container to the face of the orifice plate. As will be apparent to one skilled in the art, the height of the wick, as shown in FIGS. 3 and 4, may be adjusted to vary the liquid gap 14, as shown in FIG. 4, and to assure an appropriate degree of contact between the wick and the plate. For a more detailed view of the relationship between the wick and the orifice plate, attention is directed to FIG. 4, a magnified detail of a section of FIG. 3, wherein is shown the looped wick 7, in juxtaposition with domed orifice plate 3, thereby creating a liquid gap 14, in which the liquid to be transferred is in surface tension contact with the orifice plate. While FIG. 4 shows the wick and the plate as not actually in contact, it is to be understood that this gap is for illustration only, and that plate 3 does in fact contact the wick 7 for transfer of the liquid. As shown, the passage of the wick 7 through the opening 9 in the closure element 8 is controlled by the wick holder/positioner 10. FIG. 4 also shows the mounting grommet 4 for the piezoelectric element 2, orifice plate 3, and the orifice plate flange 12, as well as the clips 6 which hold the removable cap (not shown) to the bottle closure 8.

Figure 5:
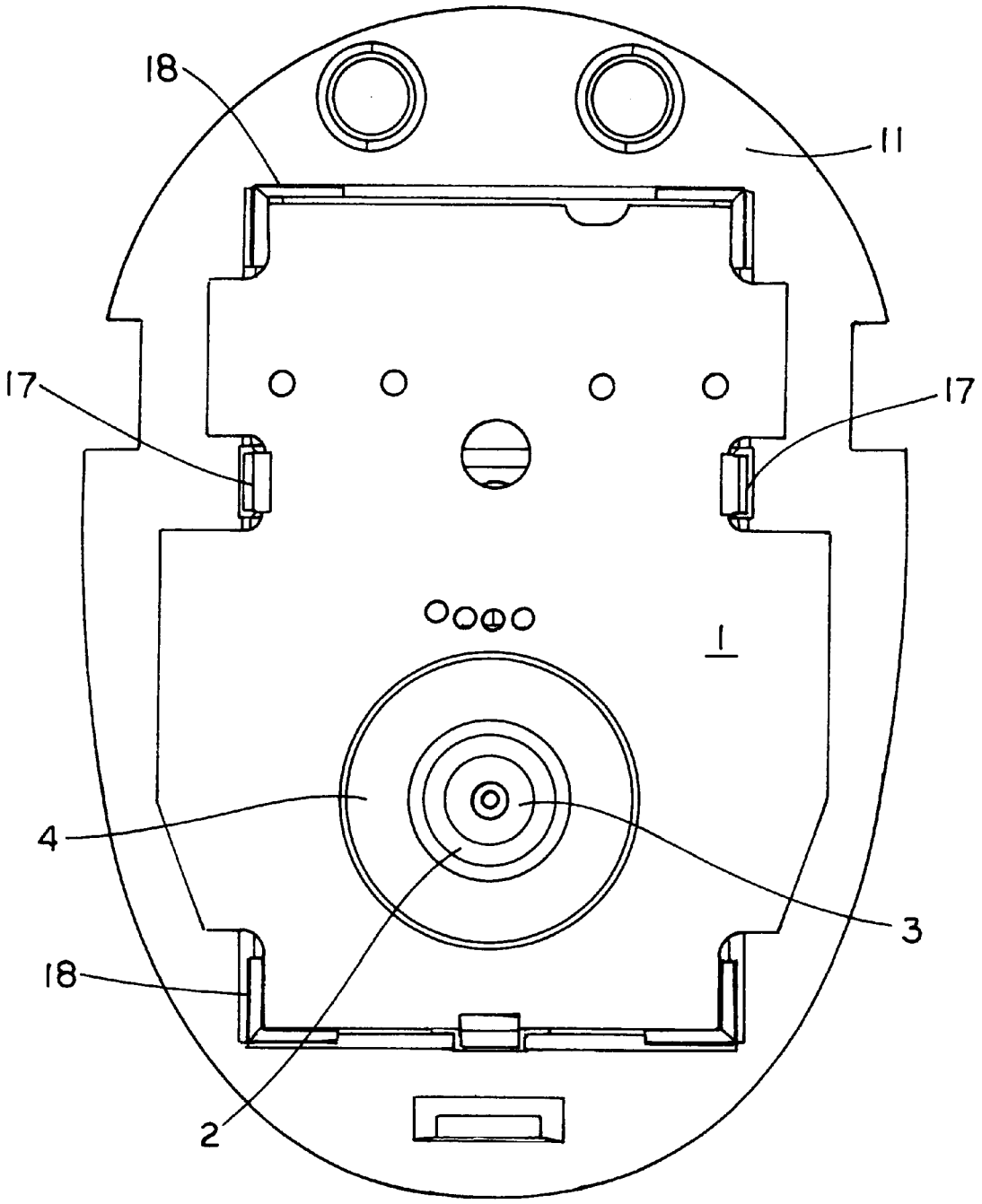
FIG. 5 is a top view of the piezoelectric element and the printed circuit board mounted on the chassis of a preferred embodiment.

FIG. 5 is a top view, showing the relationship of circuit board 1, piezoelectric element 2, orifice plate 3, mounting grommet 4, and the chassis board 11. As previously indicated, the piezoelectric element 2, in annular relationship to the orifice plate 3, is held in place in the circuit board 1 by the grommet 4. The circuit board is mounted on chassis board 11 in conventional manner, such as with clips 17 and positioning brackets 18.

Figure 6:
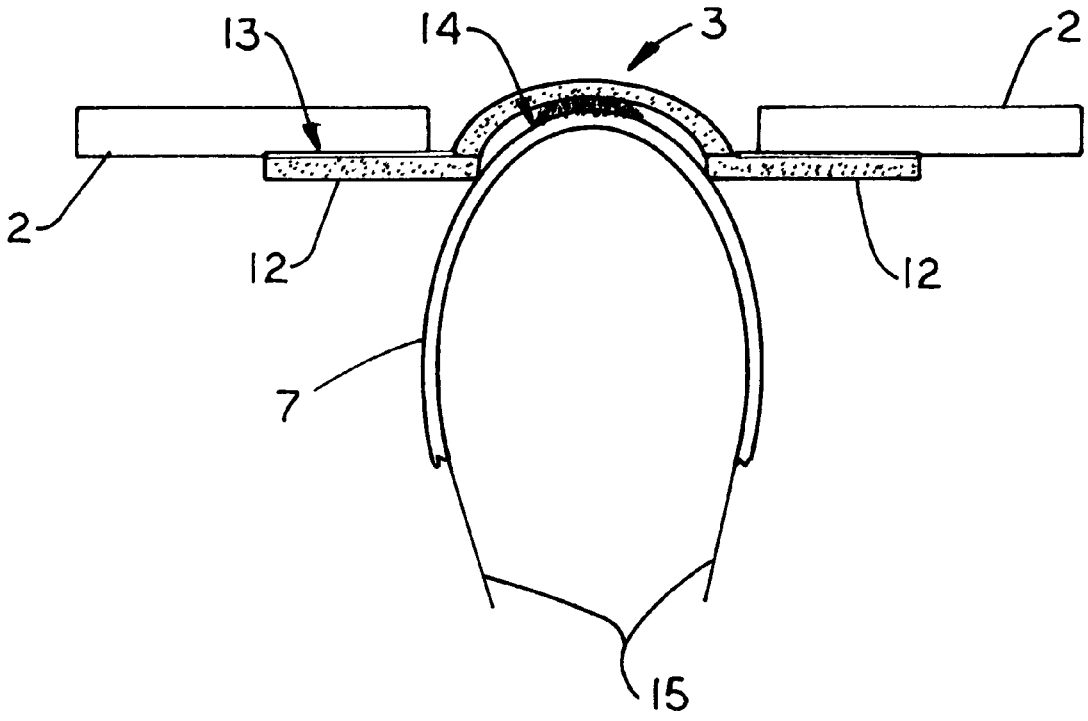
FIG. 6 illustrates a much simplified cross-sectional diagram of a piezoelectric pump assembly suitable for use with a preferred embodiment of the present invention.

In FIG. 6, a simplified cross sectional diagram of the invention illustrates the overall relationship of various elements. The orifice plate 3 is shown as including orifice plate flanges 12, which are in turn attached to the piezoelectric element 2 by suitable attachment means 13, such as epoxy adhesive. The wick 7 is illustrated in partial contact with the orifice plate 3, creating liquid gap 14, by which the liquid to be dispensed is transferred to the orifice plate. The wick is shown as also comprising fabric tails 15, which extend into the liquid container 5, not shown.

As indicated above, it has been learned that specific combinations of improvements in the elements and methods of use of the dispenser described result in surprisingly superior results. For example, it has been learned that to most readily achieve a steady and even flow of liquid for an extended time period from the liquid container to the orifice plate of the piezoelectric dispensing means, the viscosity and surface tension of the liquid must be controlled carefully. While such control is most beneficial in the preferred embodiment of the dispenser apparatus as described, it has been found to be of benefit in dispensers of varying configuration and elements.

It has been found that the viscosity of the dispensed liquid should preferably be controlled to a value of below about 10 centipoise, preferably from about 0.5 to about 5 centipoise, and most preferably from about 1 to about 4 centipoise. Formulations with viscosities above 10 centipoise were found not to atomize through 6 micron holes in the orifice plate, while viscosities in the range of 0.5 to 5 centipoise were found to provide efficient intermittent atomization for several months using a 1.5 volt AA battery.

Viscosities within these ranges enable atomization of the liquid at lower levels of energy consumption, thereby lengthening battery life in a dispenser in which the energy source is a battery rather than an electrical plug. Such improvements in energy utilization are of great value to the consumer, necessitating fewer changes of battery, and resulting in fewer variations in dispensing rate due to more level rates of power consumption.

Further, it has been found that the surface tension of the dispensed liquid should be below about 35 dynes per centimeter, as measured by the Kruss K-12 tensionmeter operating under the Wilhelmy Plate protocol, and preferably within the range of from about 20 dynes per centimeter to about 30 dynes per centimeter, and more preferably from about 20 dynes per centimeter to about 25 dynes per centimeter, particularly as the viscosity of the liquid approaches the upper limit of the preferred viscosity range. The key element of selection of surface tension within this range has been found to be that such surface tensions are appropriate to assure the spread of the liquid evenly on the back surface of the orifice plate of the piezoelectric dispensing means, and that relatively lower surface tensions are beneficial for liquids with relatively higher viscosities within the ranges indicated.

EXAMPLES

A number of fragrances were tested for rate of dispersal in an atomizer such as illustrated in the drawings. Viscosities were varied from a low of about 1.9 to about 15. The test results were as follows, with the flow rate in mg/hr, and the viscosity in centipoise.

| PERFUME | VISCOSITY | FLOW |
|---|---|---|
| A | 1.9 | 40.5 |
| B | 1.9 | 32 |
| C | 2.0 | 21.9 |
| D | 2.1 | 19 |
| E | 2.3 | 27.6 |
| F | 2.3 | 6.8 |
| G | 2.4 | 25.6 |
| H | 2.6 | 13.6 |
| I | 3.0 | 10.7 |
| J | 3.7 | 2.3 |
| K | 4.9 | 2.7 |
| L | 6.2 | 1.1 |
| M | 6.4 | DNA* |
| N | 6.7 | DNA* |
| O | 9.8 | DNA* |
| P | 10.2 | DNA* |
| Q | 14.5 | DNA* |
| R | 15.0 | DNA* |

*Did not Atomize

Further samples were tested, varying the surface tension of the liquid being tested in a cantilever beam atomizer. These samples comprised triethylene glycol (TEG), denatured alcohol solvent, and a fragrance. Some of the examples (numbers 2, 4, and 6) utilized Zonyl, a fluorosurfactant, to reduce surface tension. The viscosity and surface tension of the samples are listed below. Viscosity is in centipoise, as determined using the Bohlin CVO Rheometer system in conjunction with a high sensitivity double gap geometry. Surface Tension results, in dynes per centimeter, were generated using the Kruss K-12 tensionmeter operating under the Wilhelmy Plate protocol.

| SAMPLE | VISCOSITY | SURFACE TENSION |
|---|---|---|
| 1 | 1.4 | 22.8 |
| 2 | 1.4 | 22.9 |
| 3 | 1.9 | 24.4 |
| 4 | 2.0 | 24.4 |
| 5 | 3.8 | 29.0 |
| 6 | 3.9 | 26.7 |

It was found that improved flow results were obtained for samples in which surface tension was below about 25 dynes per centimeter and viscosity was below about 3.0 centipoise. Where both surface tension and viscosity approached the upper end of the preferred ranges, less advantage was noted, and the viscosity appears to be the more critical parameter to control.

While the present invention has been described with respect to what are at present considered to be the preferred embodiments, it is to be understood that the invention is not to be limited to the disclosed embodiments. To the contrary, the invention is intended to cover various modifications and equivalent arrangements within the spirit and scope of the appended claims. The scope of the following claims is to be accorded the broadest interpretation so as to encompass all such modifications and equivalent formulations and functions.

INDUSTRIAL APPLICABILITY

The atomization systems described in the present invention can be used to automatically dispense such liquids as air fresheners, perfumes, or insecticides, to any given environment, over an extended period of time, with the advantage of uniformly dispensing equal amounts of liquid to the atmosphere over the life span of the battery which drives the dispenser. Further, the dispenser may be reused at will by means of refills and replacement batteries, so that the consumer may change the liquid being dispersed to the atmosphere as desired, with the added advantage that the amount of liquid being dispersed may be varied to adjust intensity or effectiveness to a desired level for personal preference, efficacy, or for room size. Life of the power source is lengthened by control of the viscosity and surface tension of the liquid to be dispensed to within specified ranges.

What is claimed is:

1. A method of dispensing a liquid formulation with uniform consistency over extended periods of time, said method comprising the steps of:

providing a liquid formulation in a container, said liquid formulation having a viscosity no greater than five centipoise and a surface tension between 20 and 35 dynes per centimeter;

driving, by means of a battery, a piezoelectric actuator which is coupled to an orifice plate so that the piezoelectric actuator vibrates said plate to produce and disperse fine droplets of said liquid formulation, said plate being formed with orifices having diameters in the range of 1–25 microns; and during vibration of said plate, delivering said liquid formulation from said container to said plate by capillary action.

2. A method according to claim 1, wherein electrical power is delivered from said battery to said piezoelectric actuator in a manner to provide intermittent production of said droplets.

3. A method according to claim 1 or claim 2, wherein said liquid formulation has a viscosity of less than 3.9 centipoise.

4. A method according to claim 3, wherein said liquid formulation has a surface tension between 22.8 and 26.7 dynes per centimeter.

5. Apparatus for dispensing a liquid formulation with uniform consistency over extended periods of time, said apparatus comprising:

a battery driven piezoelectric actuator;

a liquid container which contains a liquid formulation having a viscosity no greater than five centipoise and a surface tension between 20 and 35 dynes per centimeter;

an orifice plate;

said plate being formed with orifices having diameters in the range of 1–25 microns;

said orifice plate being coupled to said piezoelectric actuator to be vibrated upon driving of said piezoelectric actuator to atomize liquid supplied to a side of said plate; and a capillary liquid delivery system extending between said container and said vibrating orifice plate to supply said liquid formulation to said vibrating orifice plate by capillary action.

6. Apparatus according to claim 5, wherein said liquid formulation has a viscosity of less than 3.9 centipoise.

7. Apparatus according to claim 6, wherein said liquid formulation has a surface tension between 22.8 and 26.7 dynes per centimeter.

* * * * *